US007437104B2

(12) United States Patent
Gilan et al.

(10) Patent No.: US 7,437,104 B2
(45) Date of Patent: Oct. 14, 2008

(54) DEVELOPER CLEANING

(75) Inventors: Ziv Gilan, San Diego, CA (US); Steven W. Steinfield, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 304 days.

(21) Appl. No.: 11/031,846

(22) Filed: Jan. 7, 2005

(65) Prior Publication Data

US 2006/0153596 A1 Jul. 13, 2006

(51) Int. Cl.
*G03G 15/00* (2006.01)

(52) U.S. Cl. ..... 399/239

(58) Field of Classification Search ..... 399/237, 399/239, 249, 348, 350, 357, 273, 283; 15/236.05, 15/236.06; 118/203
See application file for complete search history.

(56) References Cited

U.S. PATENT DOCUMENTS 3,696,785 A * 10/1972 Andrus ..... 399/283
4,325,627 A 4/1982 Swidler et al.
4,586,402 A * 5/1986 Schafer ..... 475/332
4,618,250 A * 10/1986 Noguchi et al. ..... 399/357
4,849,784 A 7/1989 Blanchet-Fincher et al.
4,974,027 A 11/1990 Landa et al.
4,984,025 A 1/1991 Landa et al.
5,003,352 A 3/1991 Duchesne et al.
5,034,778 A 7/1991 Levanon et al.
5,053,823 A 10/1991 Oh-ishi et al.
5,291,251 A 3/1994 Storlie et al.
5,300,990 A 4/1994 Thompson
5,369,477 A 11/1994 Foote et al.
5,374,982 A 12/1994 Boockkholdt
5,398,105 A 3/1995 Kuriu et al.
5,432,591 A 7/1995 Geleynse
5,435,461 A 7/1995 Smith et al.
5,447,056 A 9/1995 Foote
5,481,342 A 1/1996 Arcaro et al.
5,515,141 A 5/1996 Hanson
5,519,474 A 5/1996 Arcaro et al.
5,529,875 A 6/1996 Russell
5,576,815 A 11/1996 Teschendorf et al.
5,589,311 A 12/1996 Russell
5,666,615 A * 9/1997 Nguyen ..... 399/240
5,689,780 A 11/1997 Tamura et al.
5,713,068 A 1/1998 Teschendorf et al.
5,737,673 A 4/1998 Lang et al.
5,738,967 A 4/1998 Horii et al.
5,784,677 A 7/1998 Tamura et al.
5,805,963 A 9/1998 Teschendorf et al.
5,840,453 A 11/1998 Swidler
5,916,718 A 6/1999 Kellie et al.
5,923,412 A 7/1999 Ertel (Continued)

FOREIGN PATENT DOCUMENTS

JP 10274885 A * 10/1998

(Continued)

OTHER PUBLICATIONS

European Search Report dated Apr. 19, 2006 (2 pgs).

*Primary Examiner*—Robert Beatty

(57) ABSTRACT

A developer system component includes at least one surface configured to be driven so as to create fluid flow providing a shear force adjacent a cleaner.

47 Claims, 5 Drawing Sheets

U.S. PATENT DOCUMENTS

| | | | | |
|---|---|---|---|---|
| 5,937,250 | A | 8/1999 | Kwak et al. | |
| 5,965,314 | A | 10/1999 | Herman et al. | |
| 5,970,273 | A | 10/1999 | Zenk et al. | |
| 6,088,556 | A | 7/2000 | Nagasaki et al. | |
| 6,088,560 | A | 7/2000 | Zenk et al. | |
| 6,091,918 | A | 7/2000 | Kellie et al. | |
| 6,094,553 | A * | 7/2000 | Shima | 399/237 |
| 6,195,520 | B1 | 2/2001 | Liu et al. | |
| 6,317,578 | B1 | 11/2001 | Kusayanagi | |
| 6,321,054 | B1 * | 11/2001 | Park | 399/249 |
| 6,370,347 | B1 | 4/2002 | Shin et al. | |
| 6,438,352 | B1 | 8/2002 | Landa et al. | |
| RE37,859 | E | 9/2002 | Lior et al. | |
| 6,501,932 | B2 * | 12/2002 | Obu et al. | 399/237 |
| 6,546,221 | B2 | 4/2003 | Baker et al. | |
| 6,553,205 | B1 | 4/2003 | Liu | |
| 6,647,234 | B2 | 11/2003 | Herman et al. | |
| 6,775,501 | B2 * | 8/2004 | Kim | 399/237 |
| 2001/0036374 | A1 * | 11/2001 | Chang et al. | 399/249 |

FOREIGN PATENT DOCUMENTS

| | | | |
|---|---|---|---|
| JP | 2000010391 | | 1/2000 |
| JP | 2001242716 | A * | 9/2001 |
| JP | 2001296747 | | 10/2001 |
| JP | 2003241522 | A * | 8/2003 |

* cited by examiner

DEVELOPER CLEANING

BACKGROUND

Liquid electrophotographic printing systems may use one or more developers for applying liquid ink to a surface of an electrostatically charged photoconductor. Such developers sometimes employ a roller for applying the liquid ink. Cleaning mechanisms for cleaning the roller may increase the torque demands of the motor driving the system, may create bubbles causing leaks and poor print quality and may have a short useful life due to material fatigue and degradation of the foam material.

DETAILED DESCRIPTION OF THE EXAMPLE EMBODIMENTS

Figure 1:
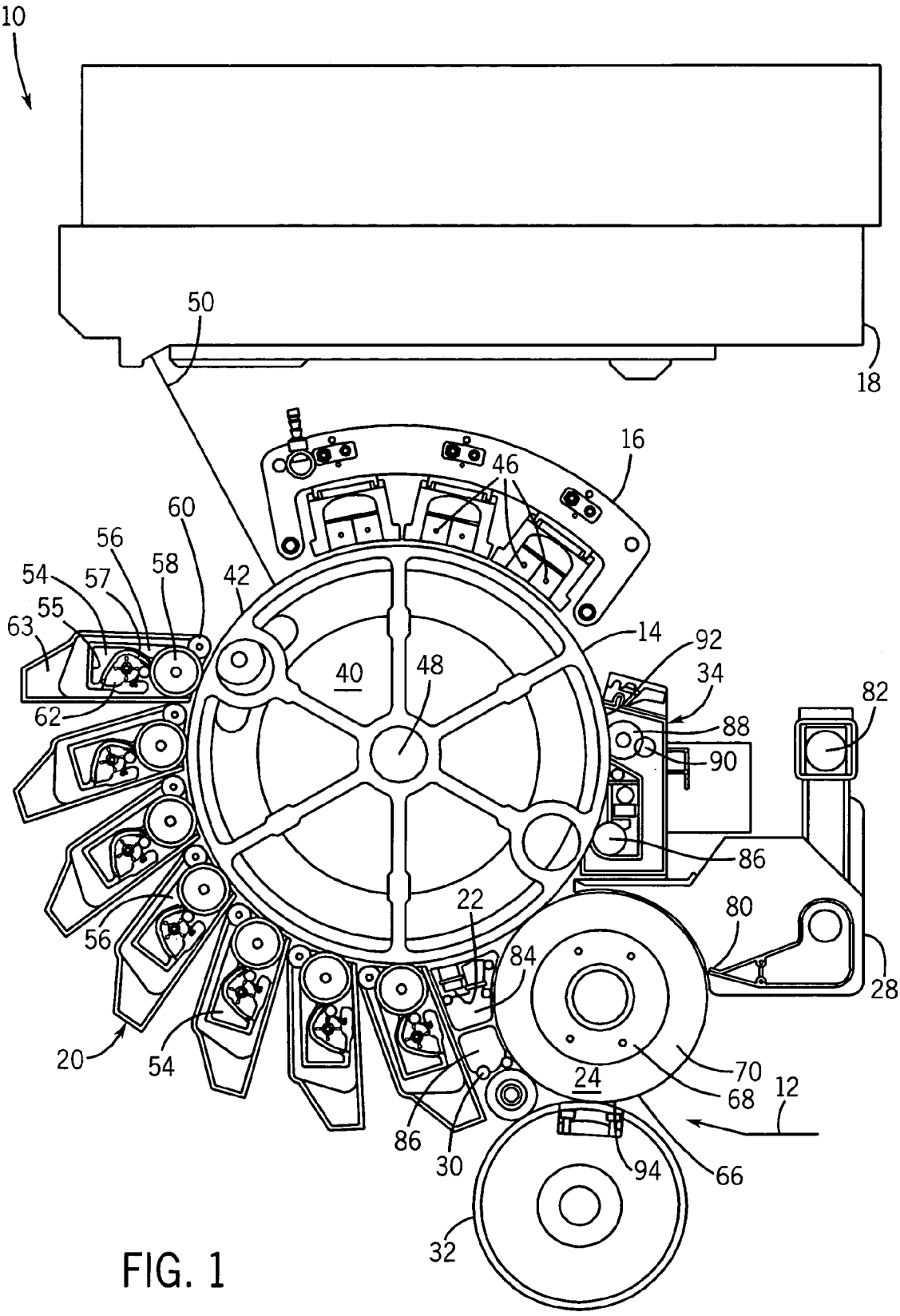
FIG. 1 is an elevational view illustrating a printer including developer units according to one exemplary embodiment.

FIG. 1 is a schematic illustration of an imaging system or printer 10 configured to form an image upon a print medium 12 according to one exemplary embodiment. Printer 10, sometimes embodied as part of an offset color press, generally includes photoconductor 14, charger 16, imager 18, developer units 20, charge eraser 22, intermediate transfer member 24, dryers 28, 30, impression member 32 and photoconductor cleaning station 34. Photoconductor 14 generally comprises a cylindrical drum 40 supporting an electrophotographic surface 42, sometimes referred to as a photo imaging plate (PIP). Electrophotographic surface 42 comprises a surface configured to be electrostatically charged and to be selectively discharged upon receiving light from imager 18. Although surface 42 is illustrated as being supported by drum 40, surface 42 may alternatively be provided as part of an endless belt supported by a plurality of rollers. In such an embodiment, the exterior surface of the endless belt may be configured to be electrostatically charged and to be selectively discharged for creating an electrostatic field in the form of an image.

Charger 16 comprises a device configured to electrostatically charge surface 42. In the particular example shown, charger 16 includes 6 corotrons or scorotrons 46. A more detailed description of the exemplary charger 16 may be found in U.S. Pat. No. 6,438,352, the full disclosure of which is hereby incorporated by reference. In other embodiments, other devices for electrostatically charging surface 42 may be employed.

Imager 18 generally comprises any device configured to direct light upon surface 42 so as to form an image. In the example shown, imager 18 comprises a scanning laser which is moved across surface 42 as photoconductor 14 is rotated about axis 48. Those portions of surface 42 which are impinged by the light or laser 50 become electrically conductive and discharge electrostatic charge to form an image (and latent image) upon surface 42.

Although imager 18 is illustrated and described as comprising a scanning laser, imager 18 may alternatively comprise other devices configured to selectively emit or selectively allow light to impinge upon surface 42. For example, in other embodiments, imager 18 may alternatively include one or more shutter devices which employ liquid crystal materials to selectively block light and to selectively allow light to pass through to surface 42. In other embodiments, imager 18 may alternatively include shutters which include individual micro or nano light blocking shutters which pivot, slide or otherwise physically move between the light blocking and light transmitting states. Examples of such physical shutters described in co-pending U.S. patent application Ser. No. 10/916,690 filed on Aug. 12, 2004 by Dale R. KOPF et al. and entitled IMAGE-FORMING APPARATUS, the full disclosure of which is hereby incorporated by reference.

In still other embodiments, surface 42 may alternatively comprise an electrographic surface including an array of individual pixels configured to be selectively charged or selectively discharged using an array of switching mechanisms such as transistors or metal-insulator-metal (MIM) devices forming an active array or a passive array for the array of pixels. In such an embodiment, charger 16 may be omitted.

Developer units 20 comprise devices configured to apply printing material 54 to surface 42 based upon the electrostatic charge upon surface 42 and to develop the image upon surface 42. In the particular example shown, printing material 54 generally comprises a liquid or fluid ink comprising a liquid carrier and colorant particles. The colorant particles may have a size of less than 2 microns, although other sizes may be employed in other embodiments. In the example illustrated, printing material 54 generally includes approximately 2% by weight, colorant particles or solids prior to being applied to surface 42. In one embodiment, the colorant particles include a toner binder resin comprising hot melt adhesive. In one particular embodiment, printing material 54 comprises HEWLETT-PACKARD ELECTRO INK commercially available from Hewlett-Packard.

Each developer unit 20 generally includes a toner chamber 55, a main electrode 56, a back electrode 57, a developer roller 58, a squeegee roller 60, a developer cleaning system 62 and a reservoir 63. Toner chamber 55 comprises a cavity having an inlet (not shown) through which printing material is supplied from reservoir 63 to chamber 55 and to between electrode 56 and developer roller 58. Main electrode 56 and back electrode 57 comprise members situated opposite to developer roller 58 and configured to be electrically charged. In the particular example shown, back electrode 57 has a dielectric tip opposite roller 58 and cooperates with electrode 56 to form toner chamber 55.

Developer roller 58 comprises a roller configured to be rotatably driven and electrically charged to a voltage distinct from the voltage of electrode 56 so as to attract electrically charged ink particles or colorant particles of printing material 54 as roller 58 is rotated. Roller 58 is charged such that the charged ink particles being carried by roller 58 are further attracted and drawn to those portions of surface 42 that are electrostatically charged.

Squeegee roller 60 removes excess printing material 54 from the surface of roller 58. In particular embodiments, squeegee roller 60 may be selectively charged to control the thickness or concentration of printing material 54 upon the surface of roller 58. In the example shown, electrode 58 and squeegee roller 60 are appropriately charged so as to form a substantially uniform 6 micron thick film composed of approximately 20% solids on the • surface of roller 58 which is substantially transferred to surface 42.

Developer cleaning system 62 removes printing material 54 from developer roller 58 which has not been transferred to surface 42. The removed printing material 54 is mixed and pumped back to a reservoir 63 in which colorant particles or solid content of the liquid or fluid is precisely monitored and controlled. As will be described in greater detail with respect to FIG. 2, developer cleaning system 62 removes printing material 54 utilizing components that may be driven using lower torque, that may create fewer bubbles so as to reduce leaks and provide acceptable print quality and may be more robust and durable so as to have a longer useful life.

Charge eraser 22 comprises a device situated along surface 42 and configured to remove residual charge from surface 42. In one embodiment, charge eraser 22 may comprise an LED erase lamp. In particular embodiments, eraser 22 may comprise other devices or may be omitted.

Intermediate transfer member 24 comprises a member configured to transfer printing material 54 from surface 42 to print medium 12. Intermediate transfer member 124 includes an exterior surface 66 which is resiliently compressible and which is configured to be electrostatically charged. Because surface 66 is resiliently compressible, surface 66 conforms and adapts to irregularities on print medium 12. Because surface 66 is configured to be electrostatically charged, surface 66 may be charged to a voltage so as to facilitate transfer of printing material 54 from surface 42 to surface 66.

In the particular embodiment shown, intermediate transfer member 24 includes drum 68 and an external blanket 70 which provides surface 66. Drum 68 generally comprises a cylinder supporting blanket 70. In one embodiment, drum 68 is formed from a thermally conductive material, such as a metal like aluminum. In such an embodiment, drum 68 houses an internal heater (not shown) which heats surface 66.

Blanket 70 wraps about drum 68 and provides surface 66. In one particular embodiment, blanket 70 is adhered to drum 68. Blanket 70 includes one or more resiliently compressible layers and includes one or more electrically conductive layers, enabling surface 66 to conform and to be electrostatically charged. Although intermediate transfer member 24 is illustrated as comprising drum 68 supporting blanket 70 which provides surface 66, intermediate transfer member 24 may alternatively comprise an endless belt supported by a plurality of rollers in contact or in close proximity to surface 42 and compressible roller 32.

Dryers 28 and 30 comprise devices configured to facilitate partial drying of printing material 54 upon surface 66. Dryers 28 and 30 are arranged about intermediate transfer member 24 and configured to direct air towards surface 66 and to withdraw air from surface 66. In the particular example shown, dryer 28 forces air through exit slit 80 which forms an air knife and withdraws or sucks air via exit port 82. Similarly, dryer 70 forces air toward surface 66 via chamber 84 and sucks or withdraws air away from surface 66 via chamber 86. One specific example of dryers 28 and 30 may be found in U.S. Pat. No. 6,438,352, the full disclosure of which is hereby incorporated by reference. In other embodiments, other dryers or drying mechanisms may be employed or dryers 28 and 30 may be omitted.

Impression cylinder 32 comprises a cylinder adjacent to intermediate transfer member 24 so as to form a nip 94 between member 24 and cylinder 32. Media 12 is generally fed between intermediate transfer member 24 and impression cylinder 32, wherein printing material 54 is transferred from intermediate transfer member 24 to medium 12 at nip 94. Although impression member 32 is illustrated as a cylinder or roller, impression member 32 may alternatively comprise an endless belt or a stationary surface against which intermediate transfer member 24 moves.

Cleaning station 34 is arranged proximate to surface 66 between the intermediate transfer member 24 and charger 16. Cleaning station 34 comprises one or more devices configured to remove residual ink and electrical charge from surface 42. In particular examples shown, cleaning station 34 flows a cooled liquid, such as a carrier liquid, across surface 66 between rollers 86, 88. Adhered toner particles are removed by roller 88, which is absorbent. Particles and liquids picked up by the absorbent material of roller 88 is squeegeed out by a squeegee roller 90. The cleaning process of surface 42 is completed by station 34 using a scraper blade 92 which scrapes any remaining toner or ink from surface 66 and keeps the carrier liquid from leaving cleaning station 34. One specific example of cleaning station 34 may be found in U.S. Pat. No. 6,438,352, the full disclosure of which is hereby incorporated by reference. In other embodiments, other cleaning stations may be employed or cleaning station 34 may be omitted.

In operation, charger 16 electrostatically charges surface 42. Surface 42 is exposed to light from imager 18. In particular, surface 42 is exposed to laser 50 which is controlled by a raster image processor that converts instructions from a digital file into on/off instructions for laser 50. This results in a latent image being formed for those electrostatically discharged portions of surface 42. Ink developer units 20 develop an image upon surface 42 by applying ink to those portions of surface 42 that remain electrostatically charged. In the embodiment shown, printing material 54 contains approximately 2% solids of colorant particles prior to being applied to developer roller 60 of each developer unit 20. Printing material 54 has an approximately 6 micron thick film with approximately 20% solids on developer roller 60 prior to being applied to surface 42.

Once an image upon surface 42 has been developed, eraser 22 erases any remaining electrical charge upon surface 42 and the ink image is transferred to surface 66 of intermediate transfer member 24. In the embodiment shown, printing material 54 forms an approximately 1.4 micron thick layer of approximately 85% solids colorant particles with relatively good cohesive strength upon surface 66.

Once the printing material has been transferred to surface 66, heat is applied to printing material 54 so as to melt toner binder resin of the colorant particles or solids of printing material 54 to form a hot melted adhesive. Dryers 28 and 30 partially dry the melted liquid colorant particles. Thereafter, the layer of melted colorant particles forming an image upon surface 66 is transferred to media 12 passing between transfer member 24 and impression cylinder 32. In the embodiment shown, the melted colorant particles are transferred to print media 12 at approximately 90 degrees Celsius. The layer of melted colorant particles freeze to media 12 on contact in the nip formed between intermediate transfer member 24 and impression cylinder 32. Thereafter, any remaining printing material 54 and surface 42 is removed by cleaning station 34.

These operations are repeated for every color for preparation in the final image to be produced. In other embodiments, in lieu of creating one color separation at a time on surface 66, sometimes referred to as "multi-shot" process, the above-noted process may be modified to employ a one-shot color process in which all color separations are layered upon surface 66 of intermediate transfer member 24 prior to being transferred to and deposited upon medium 12.

Figure 2:
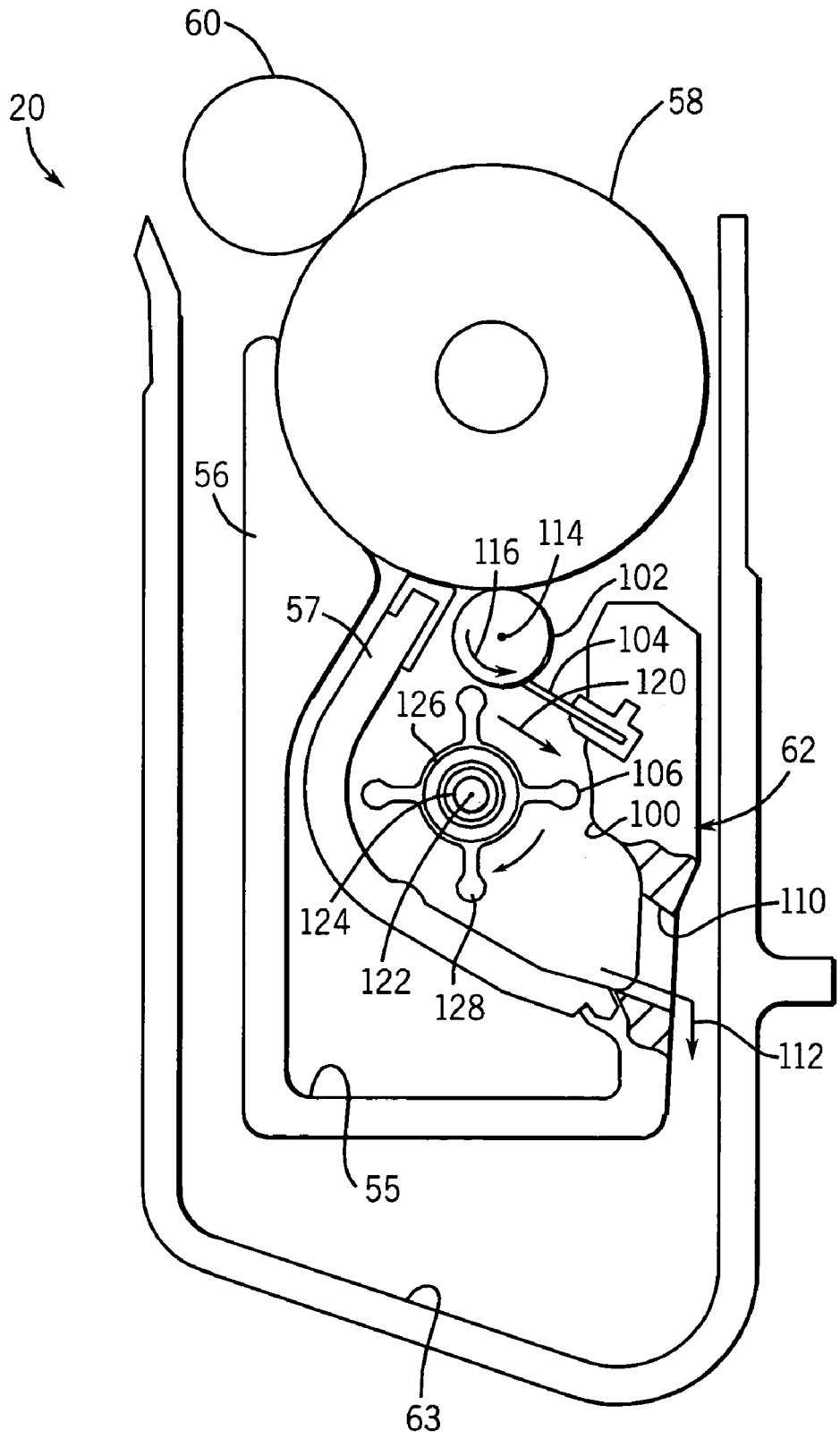
FIG. 2 is an elevational view illustrating one of the developer units of FIG. 1 according to one exemplary embodiment.

FIG. 2 is an enlarged elevational view illustration portions of developer unit 20 and cleaning system 62 in greater detail. As shown by FIG. 2, cleaning system 62 generally includes cleaning chamber 100, developer cleaner 102, developer cleaner wiper 104 and cleaning system component 106. Cleaning system chamber 100 generally comprises a walled structure forming a cavity subjacent developer roller 58. In the particular example shown, chamber 100 is partially formed by back electrode 57. In other embodiments, chamber 100 may be distinct from back electrode 57 as well as toner chamber 55 and main electrode 56. Chamber 100 receives cleaner 102, wiper 104 and component 106. Chamber 104 generally guides movement of removed printing material towards reservoir 63. In the particular example shown, chamber 100 includes an outlet port 110 through which printing material returns to reservoir 63 as indicated by arrow 112. In other embodiments, outlet port 110 may be indirectly connected to reservoir 63 by other conduits, piping, tubing and the like.

Developer cleaner 102 comprises a roller having a surface charged so as to attract and remove the printing material from the surface of roller 58. In one particular embodiment in which developer roller 58 has a charge of approximately negative 450 volts, cleaner 102 has a charge of approximately negative 250 volts. Developer cleaner 102 is located in close proximity to developer roller 58 near an upper portion of chamber 100. As a result, the printing material removed by cleaner 102 may flow towards outlet port 110 with the assistance of gravity. In the particular example shown, cleaner 102 is configured to be rotatably driven about axis 114 while in engagement with wiper 104. Although cleaner 102 is illustrated as a roller, cleaner 102 may alternatively comprise a belt movably supported by one or more rollers, wherein a surface of the belt is positioned proximate to developer roller 58 and may be electrically charged for removing printing material from developer roller 58.

Wiper 104 comprises a scraper blade supported within chamber 100 and in close proximity or in contact with the surface of cleaner 102. In the particular example shown, cleaner 102 rotates in a direction indicated by arrow 116 against wiper 104 such that the printing material is removed from the surface of cleaner 102. The removed printing material may fall with the assistance of gravity towards component 106 or may accumulate on an underside of wiper 104.

Cleaning system component 106 generally comprises a movably driven arrangement of one or more structures between cleaner 102 and wiper 104 and outlet port 110. Component 106 is configured to remove printing material from one or both of cleaner 102 and wiper 104. In the example illustrated, component 106 is further configured to mix printing material within chamber 100 and to urge or pump printing material towards outlet port 110. Cleaning system component 106 is specifically configured to assist in the removal of printing material from cleaner 102 and/or wiper 104 without contacting cleaner 102 or wiper 104. In particular, component 106 is configured to move so as to create a flow of fluid or printing material across the surfaces of cleaner 102 and/or wiper 104 to provide a shear force in the general direction indicated by arrow 120 adjacent such surfaces to remove printing material.

In the particular example shown, cleaning system component 106 comprises a mixer roller configured to be rotatably driven about axis 122. Component 106 includes a drive shaft 124, a hub 126 and a multitude of projections, veins, extensions or blades 128. Drive shaft 124 extends along axis 122 and is coupled to a torque source such as a motor (not shown). For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Hub 126 is coupled to drive shaft 124 and serves as a base or foundation for blades 128. In the embodiment shown, hub 126 is joined to drive shaft 124. In other embodiments, drive shaft 124 may alternatively comprise a single integral unitary body.

Blades 128 outwardly project from hub 126 so as to move and mix printing material within chamber 100 as component 106 is driven about axis 122. In the example shown, component 106 includes four equi-angularly spaced blades 128 extending from and integrally formed as part of a single unitary body with hub 126. In the particular example shown, blades 128 are angularly spaced from one another by about 90 degrees. Blades 128 linearly extend along axis 122 from a first axial end to a second axial end of component 106. As a result of this construction, hub 126 and blades 128 are easier to mold and may be formed using less complicated and less expensive tooling.

In the particular example shown, each blade 128 has a radial height extending from the surface of hub 126 of at least 0.5 mm. Blades 128 are supported within chamber 100 such that outer extremities of blades 128 extend no greater than 5 mm from wiper 104 when a particular blade 128 is perpendicular to wiper 104. In the particular example shown, each blade 128 extends to within 0.5 mm from blade 104 when a particular blade 128 is perpendicular to wiper 104. In the particular example shown, component 106 is rotatably driven about axis 122 at a rotational velocity of at least 60 rpm and nominally of about 600 rpm. In other embodiments, blades 128 may have other dimensions and may be rotatably driven about axis 122 at other velocities.

In the particular example shown, hub 126 and blades 128 are integrally formed as part of a single unitary body out of one or more polymeric materials such as acetal or urethane. In other embodiments, blades 128 may alternatively be fastened, bonded, welded or otherwise directly or indirectly coupled to hub 126 or drive shaft 124. In lieu of being formed from one or more polymeric materials, hub 126 and/or blades 128 may alternatively be formed from metal or a combination of metal and polymers.

Blades 128 are substantially rigid so as to retain their shape and position as component 106 is rotated about axis 122 and in engagement with printing material within chamber 100. In the particular example shown, blades 128 are dimensioned and formed from a polymeric material so as to have a durometer of at least about 40 Shore A. In other embodiments, blades 128 may be formed from other materials and may have dimensions so as to be less rigid or so as to be resiliently flexible.

In the particular example shown, the exterior surfaces of hub 126 and blades 128 are substantially non-absorbent. As a result, component 106 does not become weighted down with absorbed printing material, is less likely to have printing material accumulate on its surfaces, may be more easily cleaned and may have a longer useful life. In other embodiments, portions of hub 126 or blades 128 may alternatively be absorbent.

Overall, cleaning system component 106 facilitates the removal of printing material from cleaner 102 and/or wiper 104, mixes removed printing material within chamber 100 and urges or pumps the removed printing material towards outlet port 110. At the same time, cleaning system component 106 does not contact or substantially frictionally engage cleaner 102 and/or wiper 104, allowing component 106 to be driven with less torque. In addition, because cleaning system component 106 has a substantially non-absorbent exterior surface, cleaning system component 106 is less likely to create bubbles which cause leaks and poor print quality. Moreover, because cleaning system component 106 is not formed from an absorbent material such as foam, cleaning system component 106 may have a longer life with fewer repairs or replacements due to material fatigue or degradation.

Figure 3:
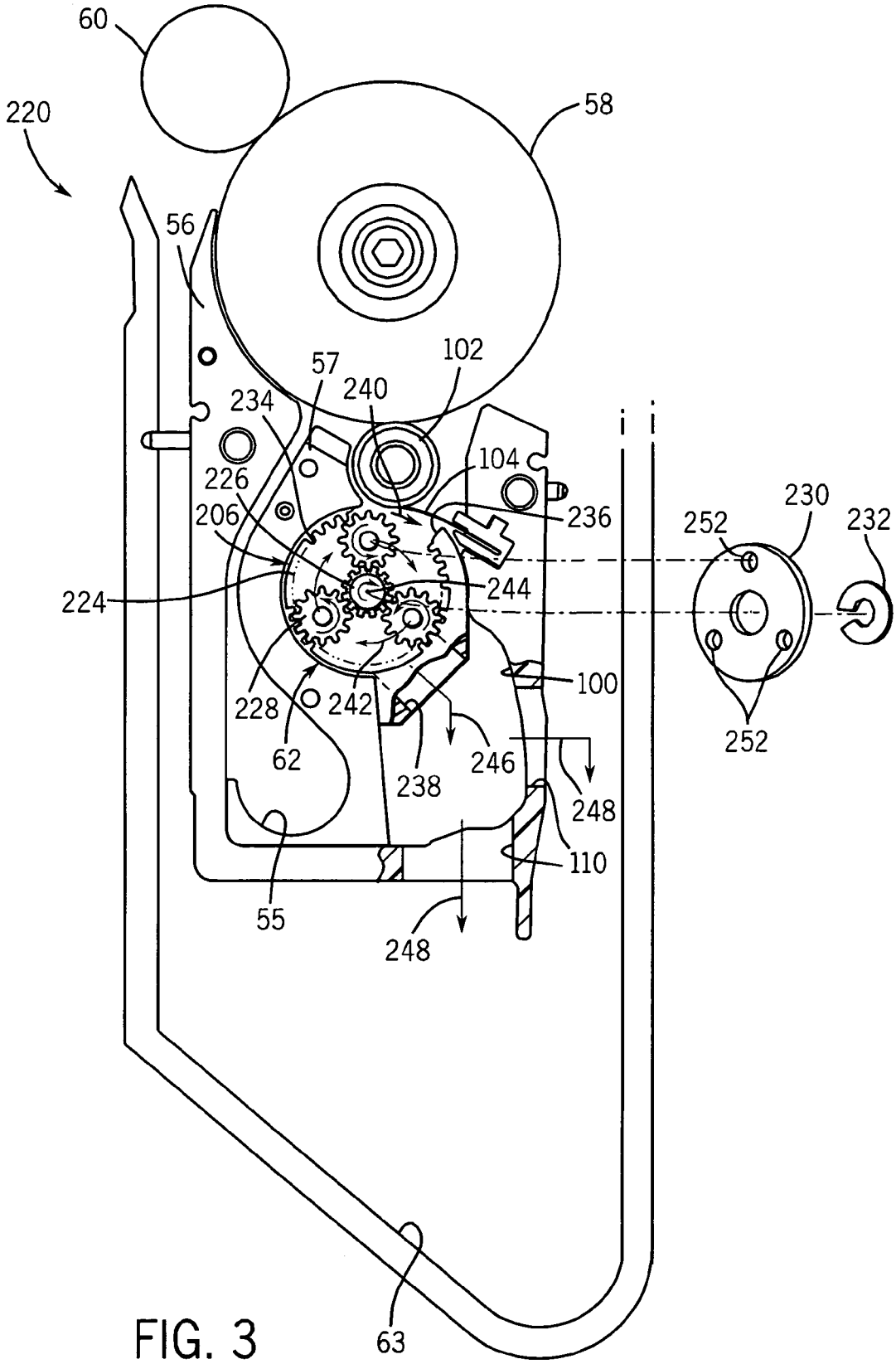
FIG. 3 is an elevational view illustrating another embodiment of the developer unit of FIG. 2 according to one exemplary embodiment.

FIG. 3 is a side elevational view of developer unit 220, another embodiment of developer unit 20 shown in FIG. 2. Developer unit 220 is substantially similar to developer unit 20 except that developer unit 220 includes cleaning system component 206. For ease of discussion, those remaining components of developer unit 220 which are substantially similar to the corresponding components of developer unit 220 are numbered similarly.

Cleaning system component 206 is situated in chamber 100 and is configured to remove printing material from cleaner 102 and/or wiper 104. Component 206 is further configured to mix printing material and to urge or pump printing material towards outlet ports 110. Component 206 generally includes ring gear 224, sun gear 226, planetary gears 228, retainer 230 and fastener 232.

Ring gear 224 extends within chamber 100 and includes a multitude of teeth 234 in meshing engagement with planetary gears 228. Ring gear 224 further includes opening 236 and drain 238. Opening 236 extends through ring gear 224 proximate to cleaner 102 and wiper 104. Opening 236 facilitates the creation of fluid flow along cleaner 102 and wiper 104 to provide a shear force in the direction generally indicated by arrow 240 as planetary gears 228 rotate in the direction indicated by arrow 242 between sun gear 226 and ring gear 224.

In the particular example shown, sun gear 226 is rotatably driven about axis 244 to rotatably drive planetary gears 228 about sun gear 226. In other embodiments, planetary gear 226 may be stationary while ring gear 224 is rotatably driven. In addition to removing printing material, rotation of planetary gears 228 about sun gear 224 further mixes printing material and pumps printing material through opening drain 238 in the direction indicated by arrow 246. Printing materials are further pumped or urged through outlet openings 110 as indicated by arrows 248.

Retainer 230 comprises one or more structures configured to retain or hold planetary gears 228 in place and relative to sun gear 226 as planetary gears 228 rotate across opening 236. In the particular example shown, retainer 230 comprises an annular ring having openings 252 in which axial ends of planetary gears are journaled. Fastener 232 (shown as a snap ring) holds retainer 230 about an axial end of sun gear 226. In other embodiments, other retaining structures may be used in lieu of retainer 230 and fastener 232 shown.

Figures 4, 7:
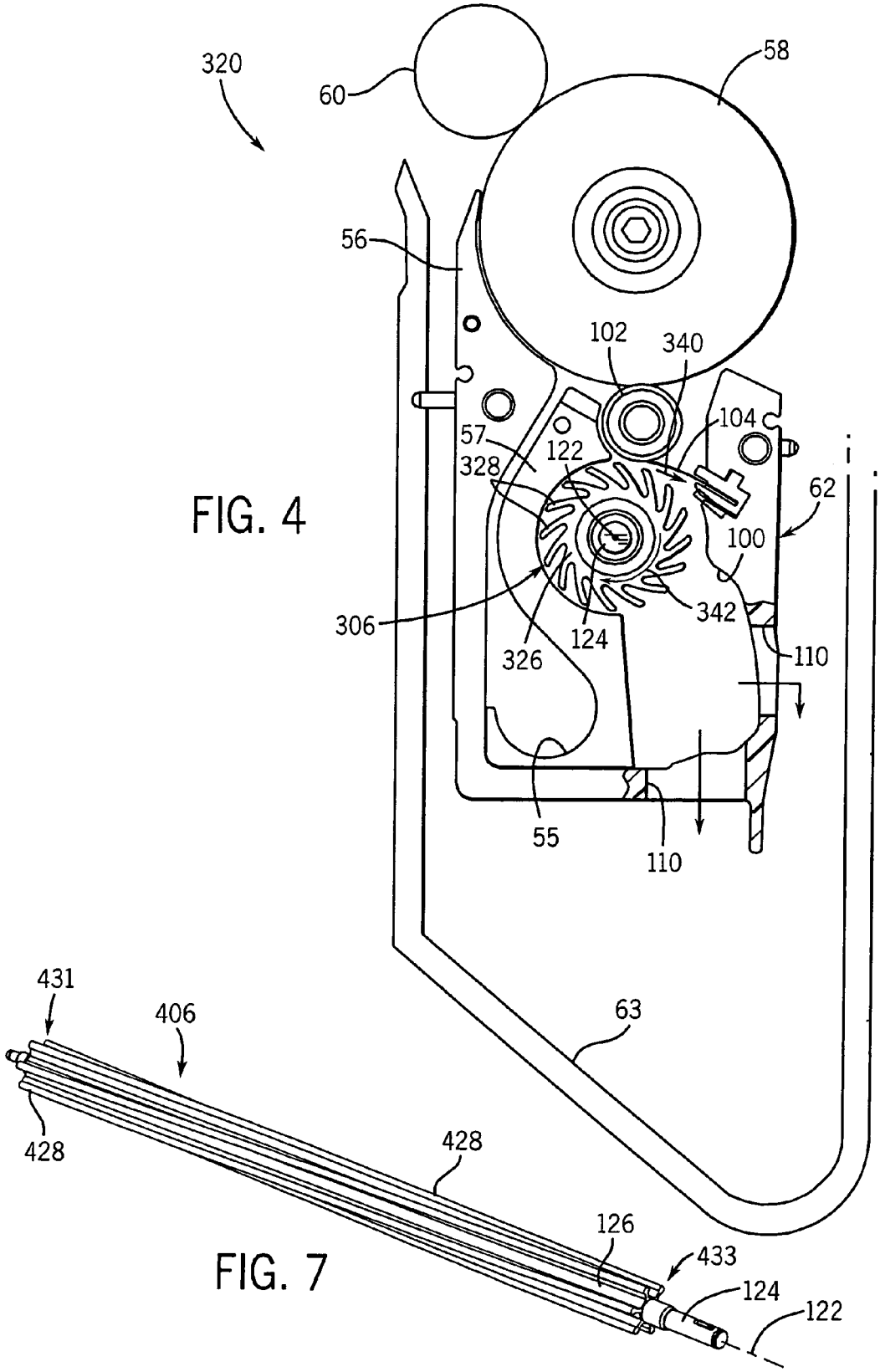
FIG. 4 is an elevational view illustrating another embodiment of the developer unit of FIG. 2 according to one exemplary embodiment.
FIG. 7 is a top perspective view of a cleaning system component of the developer unit of FIG. 5 according to one exemplary embodiment.

FIG. 4 is a side elevational view illustrating developer unit 320, another embodiment of developer unit 20 shown in FIG. 1. Developer 320 is similar to developer unit 20 except that developer unit 320 includes cleaning system component 306 in lieu of cleaning system component 106. Those remaining elements of developer unit 320 which substantially correspond to similar elements of developer unit 20 are numbered similarly.

Cleaning system component 306 is located within chamber 100 and is configured to remove printing material from one or both of cleaner 102 and wiper 104. Component 306 is also configured to mix printing material within chamber 100 and to urge or pump printing material towards outlet ports 110. In other embodiments, component 306 may alternatively be configured to perform fewer than all of the noted functions.

Cleaning system component 306 generally includes drive shaft 124 (shown and described with respect to developer unit 20 in FIG. 2), hub 326 and projections, extensions, vanes, or blades 328. Hub 326 serves as a base, foundation or support for blades 326 and is coupled to drive shaft 124. Blades 328 outwardly project from hub 326 so as to agitate and move printing material during rotation of component 306 about axis 122. In particular, blades 328 are spaced from cleaner 102 and wiper 104, enabling component 306 to rotatably be driven about axis 122 with less torque. However, blades 328 are configured to create a flow of printing material along or across-cleaner 102 and wiper 104 to provide a shear force (as indicated by arrow 340) which removes printing material.

In the particular example shown, blades 328 linearly extend along axis 122 and obliquely extend outward from hub 326. In still other embodiments, blades 328 may helically extend about and along axis 122. In the embodiment shown, blades 328 extend from hub 326 in a direction opposite to the direction in which component 306 is rotated about axis 122 (indicated by arrow 342). As a result, component 306 has a reduced overall outer diameter, enabling developer unit 320 to be more compact. In the particular example shown, blades 328 each project from hub 326 by a distance of at least 0.1 mm and a nominal distance of 5 mm and have tips radially spaced from hub 326 by a distance of at least 0.5 mm and a nominal distance of 1.5 mm. In the particular example shown, blades 328 are configured so as to have tips spaced from wiper 104 by a distance of no greater than 0.5 mm when opposite to wiper 104 during at least one point in time as component 306 is being rotatably driven about axis 122.

In the particular example illustrated, blades 328 are formed from one or more materials and are dimensioned so as to be substantially rigid and retain their position and shape as component 306 is being rotatably driven and as blades 328 are moving printing material. In one embodiment, blades 328 are formed from a polymeric material such as acetal or urethane. In other embodiments, blades 328 may be formed from metals or other rigid materials. In other embodiments, blades 328 may alternatively be dimensioned or formed from one or more other materials so as to resiliently flex with respect to hub 306. In the particular example shown, blades 328 are integrally formed as part of a single unitary body with base 306. In other embodiments, blades 328 may be bonded, welded, fused, fastened or otherwise coupled to hub 326.

Figure 5:
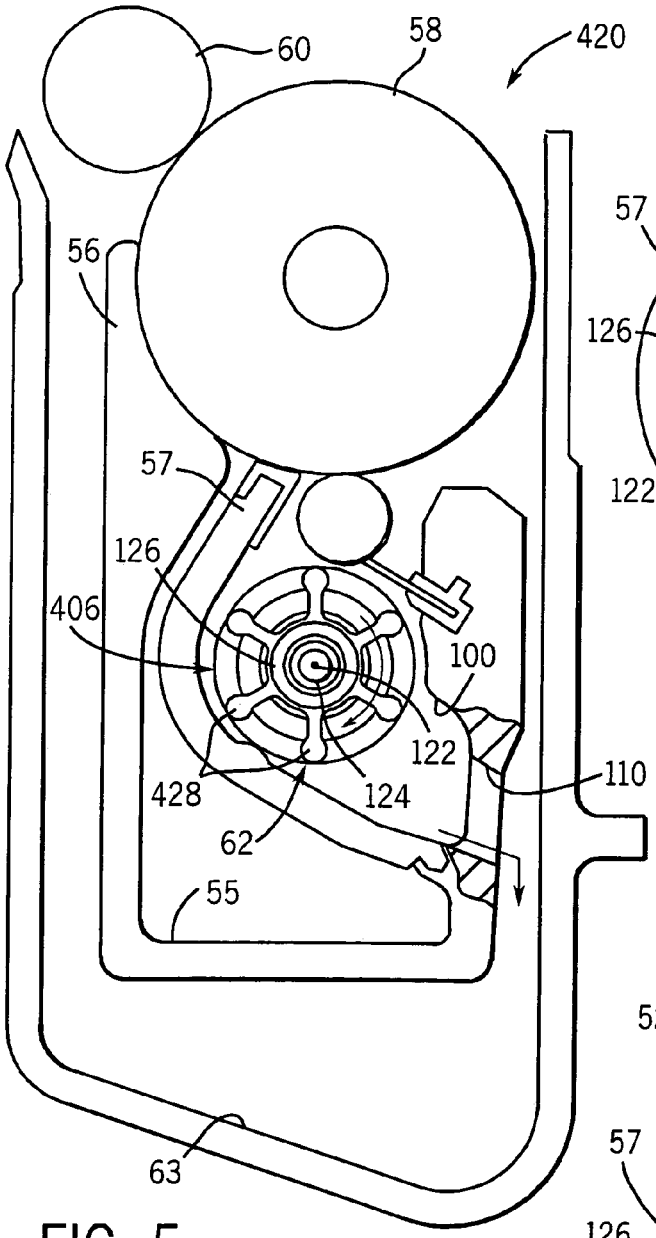
FIG. 5 is an elevational view of another embodiment of the developer of FIG. 2 according to one exemplary embodiment.
Figure 6:
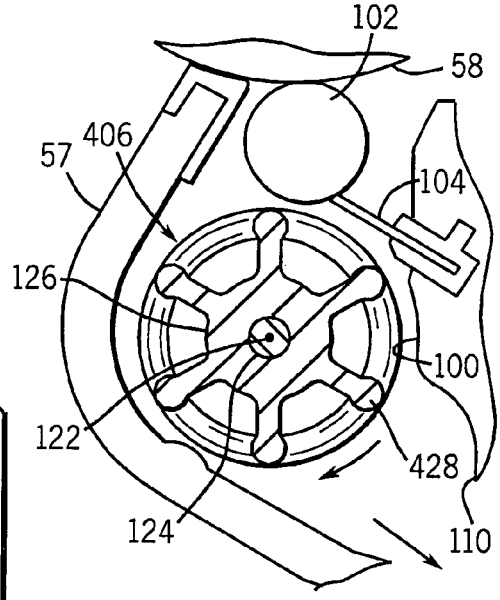
FIG. 6 is a sectional view of a portion of the developer unit of FIG. 5 according to one exemplary embodiment.

FIGS. 5 and 6 illustrate developer unit 420, another embodiment of developer unit 20 shown in FIG. 1. Developer unit 420 is substantially similar to developer unit 20 (shown in FIG. 2) except that developer unit 420 includes cleaning system component 406 in lieu of cleaning system component 106. Those remaining elements of developer unit 420 which correspond to similar elements of developer unit 20 are numbered similarly.

Cleaning system component 406 is similar to cleaning system component 106 except that cleaning system component 406 includes blades 428 in lieu of blades 128. As shown by FIGS. 6 and 7, blades 428 helically extend about and along axis 122. As a result, during rotation of component 406 about axis 122, removed printing material is further urged towards end 431 of component 406 within chamber 100. This may result in printing material accumulating and better mixing within chamber 100. In the embodiment shown, blades 428 have a pitch of between about 0.2 and 2.5 meters and nominally of about 2 meters.

Although component 406 is illustrated as including six blades 428, component 428 may alternatively include a greater or fewer number of such blades. Although component 406 is illustrated as having blades 428 configured to bias the flow of removed printing material towards end 431, blades 428 may alternatively be spiraled or otherwise configured to bias the flow of removed printing material towards the opposite end 433.

Figure 8:
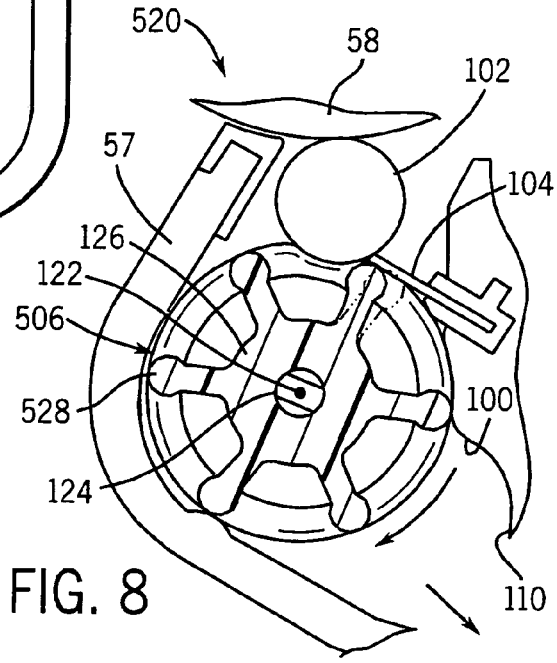
FIG. 8 is a sectional view illustrating a portion of another embodiment of the developer unit of FIG. 2 according to one exemplary embodiment.

FIG. 8 is a sectional view illustrating portions of a developer unit 520, another embodiment of developer unit 20 shown in FIG. 2. Developer unit 520 is substantially similar to developer unit 20 except that developer unit 520 includes cleaning system component 506 in lieu of component 106. Component 506 is substantially similar to component 406 (shown and described with respect to FIGS. 5-7) except that component 506 includes blades 528 in lieu of blades 428. Blades 528 are similar to blades 428 except that blades 528 are dimensioned and are formed from one or more materials so as to be resiliently flexible. In addition, component 506 is positioned within chamber 100 such that the outer extremities of blades 528 contact cleaner 102 and wiper 104. During rotation of component 506 about axis 122, blades 528 contact and wipe against cleaner 102 and wiper 104. During such contact, blades 102 resiliently flex to scrape printing material from such surfaces. In one particular embodiment, the outer extremities of blades 528 have a flexibility so as to sufficiently flex so as to move past cleaner 102 and wiper 104 while having a sufficient rigidity so as to move printing material away from cleaner 102 and wiper 104 and towards output port 110. In one embodiment, blades 528 have a durometer of between about 30 Shore A and 90 Shore A.

Although developer unit 520 is illustrated as including wiper 104, in other embodiments, wiper 104 may be replaced with a rigid stationary extension of the housing or adjacent walls, or may be replaced with a sealing gasket which seals against cleaner 102. In such an embodiment, the contact between blades 528 and cleaner 102 may sufficiently remove printing material from cleaner 102 to enable the omission of wiper 104 and to reduce the complexity and parts of developer unit 520. Although blades 528 are illustrated as having an enlarged bulbous end to establish an appropriate flexibility, blades 528 may have various other shapes and configurations such as a tapered, pointed end.

Overall, each of cleaning system components 106, 206, 306, 406 and 506 remove printing material from one or both of cleaner 102 and wiper 104, mix or assist in mixing printing material and assist in urging or pumping removed printing material. Components 106, 206, 306 and 406 remove printing material without contacting cleaner 102 or wiper 104, enabling such components to be driven with less torque. Because cleaning system components 106, 206, 306, 406 and 506 have exterior surfaces which are substantially non-absorbent, such components do not become laden with printing material, are less likely to create air bubbles in the printing material to be recycled and may have greater durability. In addition, cleaning system components 106, 206, 306, 406 and 506 may be easier to clean.

Although the foregoing has been described with reference to example embodiments, workers skilled in the art will recognize that changes may be made in form and detail without departing from the spirit and scope of thereof. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present subject matter described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a first roller configured to remove material from a developer surface that is configured to apply the material to another surface based upon an electrostatic image upon the other surface; and a component having a non-absorbent exterior configured to remove material from the first roller, wherein the component is spaced from the first roller, wherein the component is configured to rotate.

2. The apparatus of claim 1, wherein the component includes a base and at least one blade extending from the base.

3. The apparatus of claim 2, wherein the at least one blade is helical.

4. The apparatus of claim 2, wherein the at least one blade obliquely extends from the base.

5. The apparatus of claim 2, wherein the base comprises a hub and wherein the at least one blade extends outwardly from the hub.

6. The apparatus of claim 2, wherein the component is configured to move in a first direction and wherein the at least one blade extends from the base in a second opposite direction.

7. The apparatus of claim 2, wherein the at least one blade extends perpendicularly from the base.

8. The apparatus of claim 2, wherein the component includes a plurality of spaced blades.

9. The apparatus of claim 8, wherein the component includes a total of four equi-angularly spaced blades.

10. The apparatus of claim 1, wherein the component includes:

a ring gear having an opening proximate the first roller;

a sun gear; and a plurality of planetary gears between the ring gear and the sun gear.

11. The apparatus of claim 10 including a retainer coupled to the planetary gears and configured to retain the planetary gears relative to the sun gear.

12. The apparatus of claim 1 including:

a moveable developer surface;

an electrode spaced from the developer surface by a gap; and a fluid passage connected to the gap.

13. The apparatus of claim 12 including a second roller providing the developer surface.

14. The apparatus of claim 12, wherein the developer surface is configured to be charged to a first voltage distinct from a second charge of the electrode.

15. The apparatus of claim 12 including a supply of fluid including a carrier liquid and colorant particles.

16. The apparatus of claim 15, wherein the colorant particles are no greater than 2 microns in size.

17. The apparatus of claim 1, including a wiper.

18. The apparatus of claim 10 including a retainer coupled to the planetary gears and configured to retain the planetary gears relative to the sun gear.

19. A developer system comprising:

a developer configured to apply material to another surface based upon an electrostatic image upon the other surface;

a member configured to remove the material from the developer; and a component having a non-absorbent exterior configured to remove the material from the member during movement of the component, wherein the component includes spaced blades.

20. The system claim 19, wherein the component is spaced from the member.

21. The system of claim 19, wherein the component is configured to create a flow of material having a sheer force adjacent the member.

22. The system of claim 19, wherein the component is configured to mix the material.

23. The system of claim 19, wherein the component is configured to pump the material away from the member.

24. The system of claim 19 further comprising a wiper, wherein the component is configured to remove the material from the wiper without contacting the wiper.

25. The system of claim 19, wherein the member includes a roller.

26. The developer of claim 19 including:

a moveable developer surface;

an electrode spaced from the developer surface by a gap; and a fluid passage connected to the gap.

27. A method comprising:

removing fluid printing material from the a developer surface with a cleaner; and removing printing material from the cleaner with a component having at least one blade without substantially absorbing the printing material and without contacting the cleaner;

charging an electrode opposite the developer surface to a first charge different than a second charge of the developer surface; and supplying fluid printing material to between the electrode and the developer surface.

28. The method of claim 27 including transferring fluid printing material from the developer to an electrostatically charged surface in the form of an image.

29. The method of claim 28 including:

transferring the fluid printing material to an intermediate transfer member; and transferring the printing material to a print medium from the intermediate transfer member.

30. The method of claim 27, wherein the at least one blade is helical.

31. The method of claim 27 further comprising rotating the component in a first direction, wherein the at least one blade extends from the base in a second opposite direction.

32. A developer system component comprising:

a base; and a plurality of spaced blades extending from the base, the plurality of spaced blades including at least one surface configured to be driven so as to create fluid flow providing a shear force adjacent a cleaner without contacting the cleaner.

33. The component of claim 32, wherein the plurality of spaced blades are helical.

34. The component of claim 32, wherein the plurality of spaced blades obliquely extend from the base.

35. The component of claim 32, wherein the base comprises a hub and wherein the plurality of spaced blades extend outwardly from the hub.

36. The component of claim 32, wherein the component is configured to move in a first direction and wherein the plurality of spaced blades extend from the base in a second opposite direction.

37. The component of claim 32, wherein the plurality of spaced blades extend perpendicularly from the base.

38. The component of claim 32, wherein the component includes a total of four equidi-angularly spaced blades.

39. The component of claim 32, wherein the at least one surface is substantially non-absorbent.

40. The component of claim 32, wherein the cleaner is configured to remove printing material from a developer roller.

41. An apparatus comprising:

a first roller configured to remove material from a developer surface; and a component having a non-absorbent exterior configured to remove material from the first roller, wherein the component includes:

a ring gear having an opening proximate the first roller;

a sun gear; and a plurality of planetary gears between the ring gear and the sun gear.

42. A developer system component for use with a developer cleaner, the component comprising:

a ring gear having an opening and configured to be mounted adjacent the cleaner to position the opening of the ring gear opposite the cleaner;

a sun gear; and a plurality of planetary gears between the ring gear and the sun gear, wherein at least one surface of the sun gear or the plurality of planetary gears is a configured to be driven so as to create fluid flow through the opening to provide a shear force adjacent a cleaner.

43. An apparatus comprising:

a first roller configured to remove material from a developer surface that is configured to apply the material to another surface based upon an electrostatic image upon the other surface; and a component having a non-absorbent exterior configured to remove material from the first roller, wherein the component is spaced from the first roller, wherein the component includes a base and at least one blade extending from the base.

44. The apparatus of claim 43, wherein the at least one blade is helical.

45. The apparatus of claim 43, wherein the at least one blade obliquely extends from the base.

46. The apparatus of claim 43, wherein the component is configured to move in a first direction and wherein the at least one blade extends from the base in a second opposite direction.

47. A method comprising:

removing fluid printing material from the developer with a cleaner;

removing printing material from the cleaner with a component having at least one blade without substantially absorbing the printing material and without contacting the cleaner; and a transferring fluid printing material from the developer surface to an electrostatically charged surface in the form of an image.

* * * * *

UNITED STATES PATENT AND TRADEMARK OFFICE

CERTIFICATE OF CORRECTION

PATENT NO. : 7,437,104 B2
APPLICATION NO. : 11/031846
DATED : October 14, 2008
INVENTOR(S) : Ziv Gilan et al.

It is certified that error appears in the above-identified patent and that said Letters Patent is hereby corrected as shown below:

In column 11, line 44, in Claim 27, delete “the a” and insert -- a --, therefor.

In column 12, line 50, in Claim 42, delete “is a” and insert -- is --, therefor.

In column 13, line 7, in Claim 47, delete “the developer” and insert -- a developer surface --, therefor.

Signed and Sealed this

Third Day of March, 2009

John Doll

JOHN DOLL
*Acting Director of the United States Patent and Trademark Office*